United States Patent [19]

Swann

[11] 4,259,552

[45] Mar. 31, 1981

[54] ELECTRIC SWITCHES

[76] Inventor: David A. Swann, P.O. Box 350, Mt. Waverley, Victoria, 3149, Australia

[21] Appl. No.: 897,728

[22] Filed: Apr. 19, 1978

Related U.S. Application Data

[63] Continuation of Ser. No. 712,095, Aug. 5, 1976, abandoned.

[30] Foreign Application Priority Data

Aug. 8, 1975 [AU] Australia ..... 2714/75

[51] Int. Cl.[3] ..... H01H 21/00

[52] U.S. Cl. ..... 200/6 R; 200/67 G

[58] Field of Search ..... 200/1 B, 6 R, 6 B, 6 BA, 200/6 BB, 67 G, 153 N, 315, 339

[56] References Cited

U.S. PATENT DOCUMENTS

| | | | |
|---|---|---|---|
| 3,529,109 | 9/1970 | Cross | 200/6 R X |
| 3,536,872 | 10/1970 | Gilardenghi | 200/67 G |
| 3,639,714 | 2/1972 | Fujimoto et al. | 200/67 G X |
| 3,711,663 | 1/1973 | Sorenson | 200/67 G |
| 4,147,908 | 4/1979 | Swann | 200/67 G |

*Primary Examiner*—James R. Scott

*Attorney, Agent, or Firm*—Cushman, Darby & Cushman

[57] ABSTRACT

The present invention provides an electric switch comprising an actuator, a first electrical contact which acts are a fulcrum, a second electrical contact and a contact bridging member. The contact bridging member is slidably movable over the fulcrum and pivots thereabout whereby to bring the leading or trailing end of the member into or out of contact with the second contact. Platform means are provided on the side of the fulcrum remote from the second contact to support the member in a position out of contact with the second contact. A further embodiment provides an electrical switch comprising a plurality of such switching assemblies. A single actuator is adapted to move both the contact bridging members, and the fulcrums of the first and second switch assemblies are positioned to obtain multiposition characteristics.

6 Claims, 12 Drawing Figures

Fig. 1
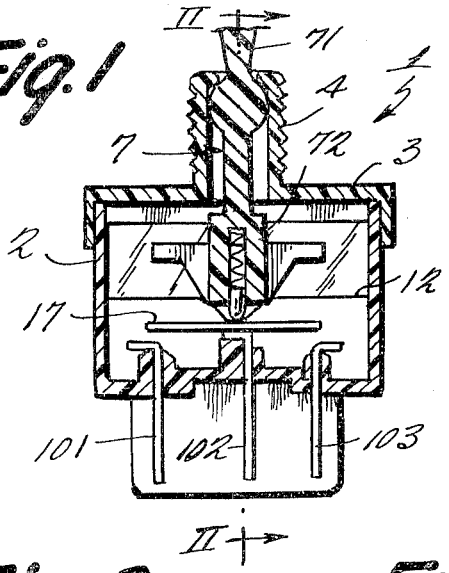
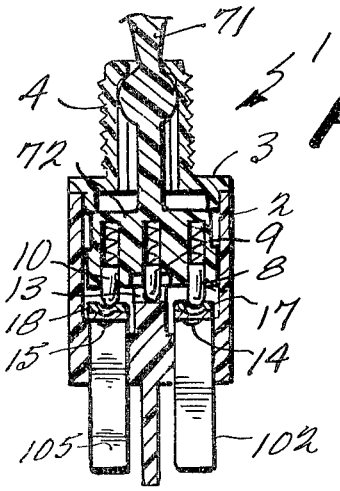
Fig. 2
Fig. 3
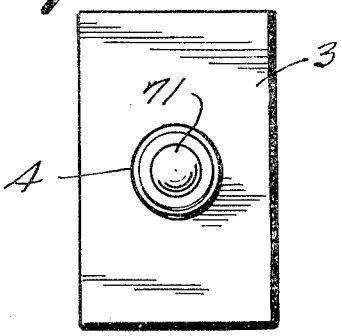
Fig. 4
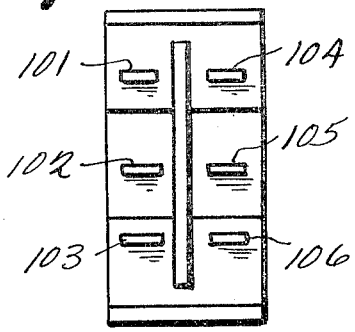
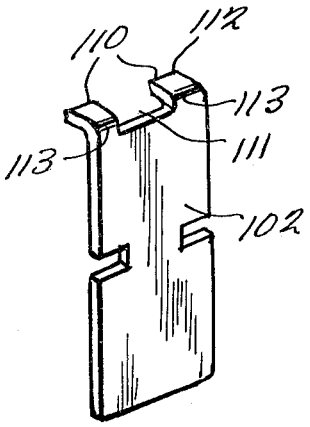
Fig. 5
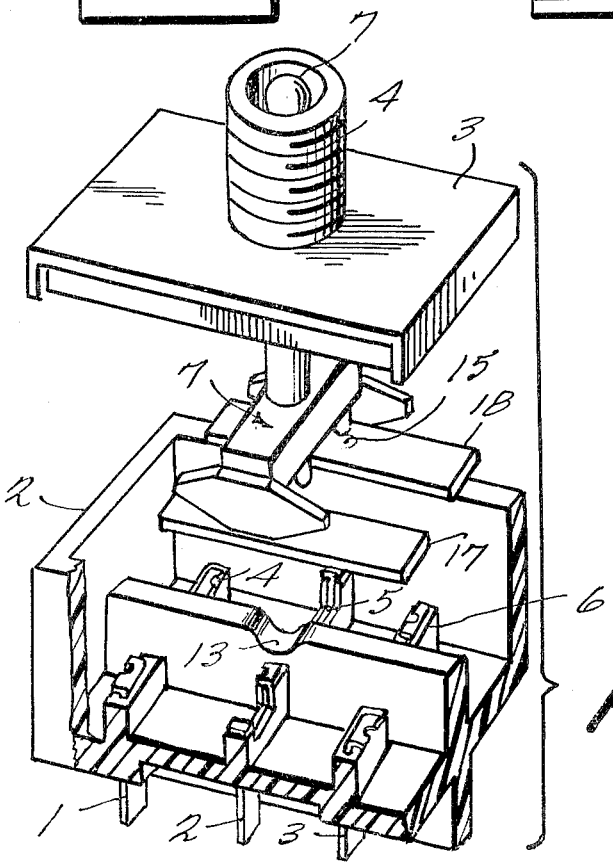
Fig. 6
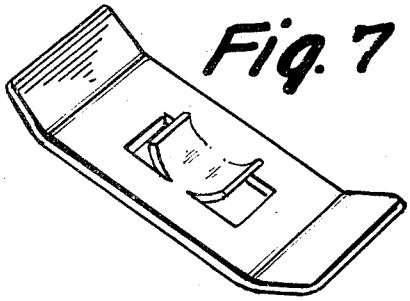
Fig. 7

ELECTRIC SWITCHES

This is a continuation of application Ser. No. 712,095 filed Aug. 5, 1976, now abandoned.

REFERENCE TO RELATED APPLICATIONS

Reference is made to applicant's co-pending U.S. patent application Ser. Nos. 634,175; 634,176; 634,177 all filed Nov. 21, 1975, now abandoned, and the whole of the subject matter of the specifications thereof is to be considered as being imported hereinto and it is to be noted that the present invention will find application therein and/or that the inventions therein will find application in the present invention.

BACKGROUND OF THE INVENTION

The present invention relates to electrical switches and more specifically to center-off floating contact switches.

Electric switches including an electrical contact which operates as a fulcrum with respect to a contact bridging member, the bridging member sliding over the fulcrum contacts and pivots thereabout to bring one end of the bridging member into contact with, or break contact with, a second electrode. Examples of such switches are described in U.S. Pat. Nos. 3,711,663 issued Jan. 16, 1973 to R. Sorenson, and 3,536,872 issued Oct. 27, 1970 to B. Gilardenghi.

One aspect of the present invention provides such a switch wherein platform means are provided on the fulcrum contact on the side of the fulcrum remote from the second contact. The platform means operates to support the bridging member intermediate its length with the end adjacent the second contact being unsupported and out of contact with the second contact, to thereby provide a stable center-off position.

Similarly, an electrical contact having spaced apart portions, respectively acting as first and second fulcrums, can be provided with platform means intermediate the first and second fulcrums. Second and third contacts can be provided respectively adjacent the first and second fulcrums on opposite sides of the fulcrum contact.

The fulcrum electrical contact preferably has an end surface which serves as the platform means and that surface has an edge serving as the operational fulcrum, in an instance in which only one fulcrum is required, or edges serving as the first and second fulcrums.

In a particularly preferred construction the first contact has a bent over end which defines a surface which serves as the platform means and an edge serving as the fulcrum, in an instance in which only one fulcrum is required, or edges as the first and second fulcrums.

As it will be preferred in some instances that the first and second fulcrums are equidistantly spaced from, respectively, the second and third contacts, the first contact will preferably comprise a portion more adjacent to one of the second and third contacts than the other of the second and third contacts and that the bent over end extends toward said other of the second and third contacts.

In other instances it will be preferred that the first and second fulcrums are not equidistantly spaced from, respectively, the second and third contacts.

The bridging member may be substantially planar over its length but may have a dimple therein or struck out abutments such as are disclosed in the aforesaid co-pending applications. In the case of having a dimple, the platform means, the fulcrum or the first and second fulcrum should have means adapted to accommodate the passing thereof.

The bridging member could have a convex surface such as disclosed in the aforesaid co-pending applications which contacts the fulcrum or the first and second fulcrums and the platform means but to ensure stability it would be highly desirable that the platform means comprised a concave surface to be contacted by said member. For reasons of convenience of manufacture the convexity-concavity is not preferred.

The bridging member may have an intermediate planar portion and upturned ends (when viewed in a particular disposition) such as disclosed in the specification of U.S. patent application Ser. No. 634,177. Such a bridging member is preferred since the advantages of a convex surface are obtained without the need for convexity.

In accordance with another aspect of the invention a switch may be used with one or more further switches in accordance with the present invention, or with switches such as described in the aforesaid copending applications, all operable by a common actuator.

Such arrangements are particularly advantageous in that they provide many alternative switching states. For example, by relatively offsetting the operational fulcrums of the respective switch assemblies, the sequence of pivoting and hence, switching as between the respective switching assemblies can be controlled.

While the above-mentioned platform means is not requisite to this further aspect of the invention, it is often desirable to use such platform means in that further switching positions may be provided. Further the relative positions of the respective lengths of the platform means of the various cooperating switching assemblies can be utilized to define the switching sequence.

In a particularly preferred construction, the first and second switchgear assemblies are side by side. The second switchgear contacts lie in a plane and the first contacts lie in spaced apart planes generally parallel to the plane in which the second contacts lie.

Preferred exemplary embodiments of electrical switches in accordance with the present invention will now be described in conjunction with the accompanying drawings wherein:

FIG. 1 is a cross-sectional view of a switch in accordance with a first embodiment of the invention;

FIG. 2 is another cross-sectional view of the switch of FIG. 1 taken approximately on line 11—11 in FIG. 1;

FIG. 3 is a top plan view of the switch;

FIG. 4 is a bottom plan view of the switch;

FIG. 5 is a perspective view of part of the switch;

FIG. 6 is an exploded perspective of a switch in accordance with the present invention;

FIG. 7 is a perspective view of an alternative part of the switch;

Figure 8:
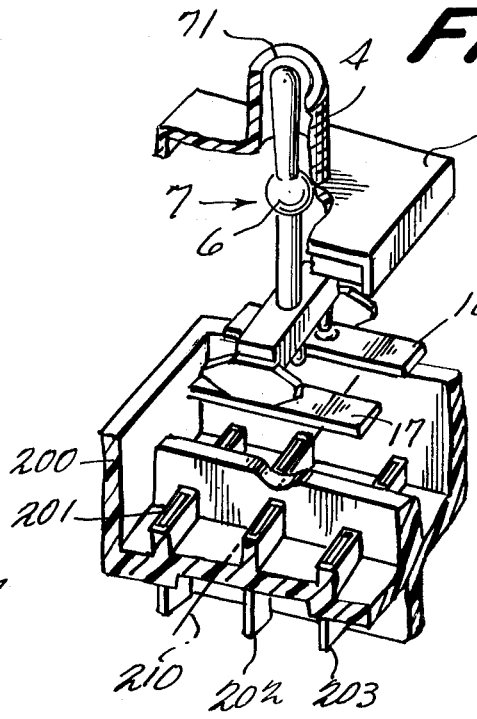
FIG. 8 is a schematic perspective view of part of a switch in accordance with another embodiment of the invention.
Figure 10:
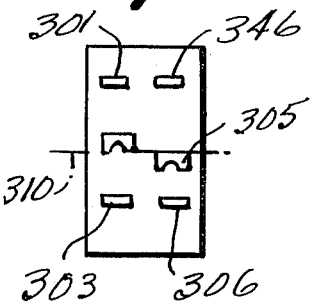
FIG. 10 is a schematic plan view of part of another switch in accordance with said another embodiment.
Figure 11:
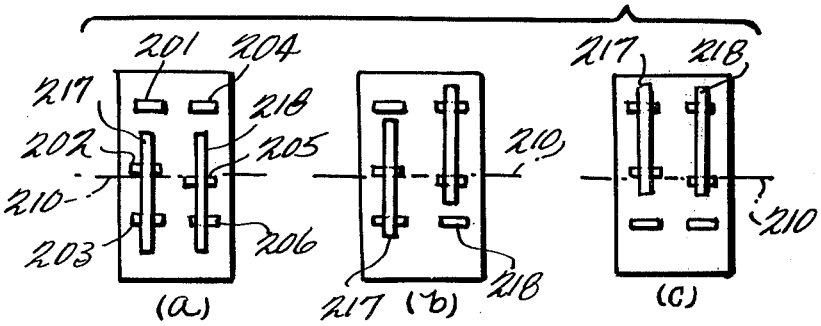
Figure 12:
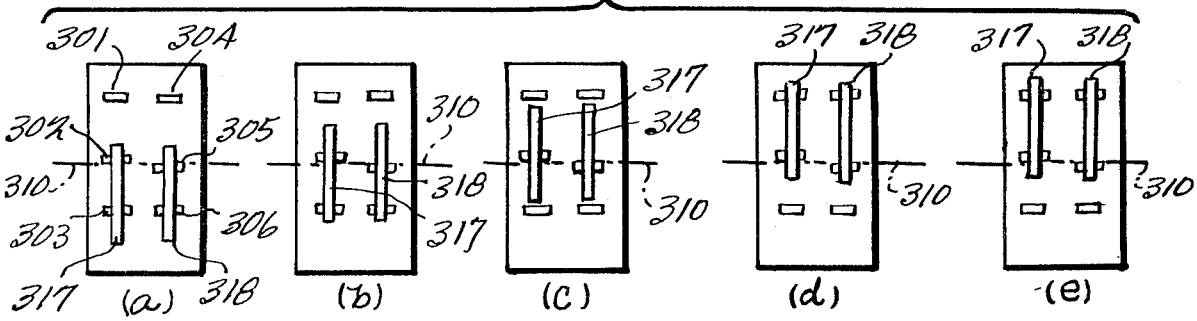

FIGS. 11*a*–11*c* are schematic representations of the modes of operation of the switch shown in FIG. 8; and FIGS. 12*a*–12*e* are schematic representations of the operational modes of switch parts shown in FIG. 10.

DETAILED DESCRIPTION

Referring now to FIGS. 1–4, a switch 1 comprises a body 2, a cover 3 having a threaded boss 4 within which is located a spherical ball 6. The ball 6 is attached to an actuator 7 having a part 71 which may be moved by a user and a part 72 which causes switching operations within the body.

The part 72 has three recesses in which three spring biased pins 8, 9 and 10 are located.

Pin 9 bears on a cam surface 12 which has a central dip 13 which defines a centre position of the actuator.

Pins 8 and 10 locate in dimples 14 and 15 in contact bridging members 17 and 18.

Six electrical contacts 101, 102, 103, 104, 105 and 106 are provided. Contacts 101, 103, 104 and 106 are identical and have bent over ends to provide larger areas for contact than if they were not so bent over. However, the bending over of contacts 101, 103, 104 and 106 is not essential.

Contacts 102 and 105 are identical and contact 102 is shown in greater detail in FIG. 5.

Referring now briefly to FIG. 5, contact 102 has a bent over end to provide a planar surface 110 which, in use, acts as a platform for the member 17 when in the position shown in FIGS. 1 and 2; namely, the central position. To permit the projection on the underside of the member 17 consequent on the provision of the dimple 14 in its upperside to pass contact 102 a slot 111 is provided in contact 102.

It is to be noted that contacts 102 and 105 are displaced from a vertical centre line through the switch so that the middle of the surface 110 intermediate its ends 112 and 113 will be on that centre line.

As will be observed from FIGS. 1 and 2, the members 17 and 18 are in a central position supported on the surfaces 110 and are stabilized in that position by pin 9 locating in dip 13 in cam surface 12. Movement of the part 72 to the right from the position shown in FIG. 1 will cause the members 17 and 18 to slide on the surfaces 110 and to pivot about the ends 113, which acts as fulcrums, to engage contacts 103 and 106. Movement of the part 72 to the left from the position shown in FIG. 1 will cause the members 17 and 18 to slide on surfaces 110 and to pivot about the ends 112, which act as fulcrums, to engage contacts 101 and 104.

Thus, given that electric power is connected to contacts 102 and 105 and that four separate devices a, b, c and d (not shown) to be run by that power are connected, respectively, to contacts 101, 103, 104 and 106, in the central position shown in FIG. 1 none of the devices will run. When actuator 7 is moved such that part 72 assumes a right hand position, position devices b and d (coupled to contacts 103 and 106) will be activated, but devices a and c (coupled to contacts 101 and 104) will be inhibited. Conversely, when part 72 is moved to a left hand position, devices a and c will be activated and devices b and d inhibited.

An alternative arrangement of contacts is schematically shown in FIG. 6. Contacts 101–106 are replaced by contacts 1–6. Contact 2 is identical to contact 102, however, contact 5 corresponding to contact 105 in FIGS. 1–4, is not bent over at its ends, nor are contacts 1, 3, 4 and 6. End 112 of contact 2, which end acts as a fulcrum, is more adjacent to contact 1 than is contact 5 to contact 4.

In the arrangement of contacts shown in FIG. 6, when moved by actuator 7 into a right hand position bridging member 17 will complete a circuit between contacts 2 and 3 and bridging member 18 will complete a circuit between contacts 5 and 6. When actuator 7 (FIG. 1) is moved into a central position, bridging member 17 will be, due to the bent end platform of contact 2, stabilized on contact 2 and out of engagement with contacts 1 and 3, while at the same time member 18, since no platform means is present on contact 5 to displace the operational fulcrum towards contact 4, as does edge 112 of contact 2, will cause a circuit to be formed between contacts 5 and 4. When actuator 7 is moved to the right, bridging member 17 will then assume a left hand position, completing a circuit between contacts 2 and 1, while member 18 maintains the circuit between contacts 5 and 4.

It may be desirable to use platform means in constructions other than that shown in FIG. 6. For example, contact 5 may be made identical to contact 102 but oriented such that the end of the platform means of contact 5 is more adjacent to contact 6 than is the end of the platform means of contact 2 with respect to contact 3. Thus, bridging member 17 would complete a circuit between contacts 5 and 6. Similarly, the end of the platform means of contact 5 may be made less adjacent to contact 4 than is the end of the platform means of contact 2 with respect to contact 1. Contact would then be made between contacts 5 and 4 prior to completion of a circuit between contacts 2 and 1.

If the contacts 2 and 5 are oriented appropriately and each includes a platform means, it is possible to obtain a five position switch in which, referring to FIG. 6, a first position of the switch has member 17 bridging contacts 2 and 3 and member 18 bridging contacts 5 and 6, a second position of the switch having, for example, member 17 on the contact 2 and making no circuit and member 18 bridging the pair of contacts 5 and 6, a third position of the switch having member 17 and member 18 on, respectively, contact 2 and contact 5 and both making no circuit and a fourth position having, for example, member 18 on the contact 5 and making no circuit and member 17 bridging the pair of contacts 2 and 3. It is to be noted that dependent on the dimensions of one platform means as against the other platform means various other circuit arrangements can be obtained. However, it is also to be noted that such five position switches may need to have a cam surface similar to 12 in FIG. 1 or other detent means appropriate to the five positions so as to reduce the likelihood of skating through positions intermediate the end position.

It should be appreciated that the switch of FIG. 6 may be modified such that the contacts 3 and 6 are omitted. Thus in the right hand position no circuit will be made, in the central position one circuit will be made and in the left hand position two circuits will be made.

A modified form of the member 17 is shown in FIG. 7 and has the outwardly struck portion disclosed in the specification of U.S. patent application Ser. No. 634,175 now abandoned and the central planar portion with upturned ends disclosed in the specification of U.S. patent application Ser. No. 634,177, now abandoned. The contact bridging member shown in FIG. 7 preferably has a plan projected length greater than the minimum spacing of contacts 101 and 103.

As stated above, the embodiment of FIG. 6 does not necessarily rely on platform means, but rather utilizes the relative dispositions of the operational fulcrums with respect to the first and second switchgear assemblies to allow or enable a pivoting sequence to occur.

A switch in accordance with the embodiment of the invention not using platform means to displace the respective operational fulcrums, will now be described with reference to FIGS. 8–12.

FIG. 8 shows such a switch in exploded perspective comprising a base 200 which will normally be a part of a casing similarly as in FIGS. 1–4, of which contacts 201, 202 and 203 are part of a first switchgear assemblies and contacts 204, 205 and 206 are part of a second switchgear assembly. An actuator 7 as suitably described in conjunction with FIGS. 1–4, cooperates with respective bridging members 217 and 218.

It is to be noted that contacts 201 and 204 are planar and lie in a single plane parallel to a plane passing through a centre of the base 200 and which centre is represented by dash line 210. Contacts 203 and 206 are also planar and lie in another single plane parallel to said plane passing through a centre.

Contacts 202 and 205 are planar but each lies in a separate plane parallel to and on opposite sides of said plane passing through a centre; for example, contacts 202 and 205 are staggered with respect to one another. This staggered relation is best seen in FIG. 9.

Actuator 7 will cause members 217 and 218 to move in similar manners. However, since contact 203 is more adjacent to contact 206 than contact 202 is to contact 203 the members 217 and 218 will pivot at different positions of the actuator. This is shown schematically in FIGS. 11*a*–11*c*, wherein members 217 and 218 are represented by thick lines and contacts 201–206 are represented by thin lines. In the position shown in FIG. 11*a*, members 217 and 218 bridge, respectively, contacts 202 and 203, and 205 and 206. In the position of FIG. 11*b*, (the position shown in FIG. 9), member 217 bridges contacts 202 and 203 and member 218 bridges contacts 204 and 205. In the position of FIG. 11*c*, members 217 and 218 bridge, respectively, contacts 201 and 202, and 204 and 205.

Figure 9:
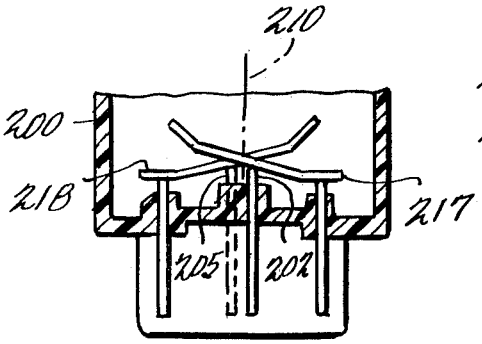
FIG. 9 is an elevation view on line 1X–1X in FIG. 8 of the part shown therein and shows additional parts.

An alternative to the construction shown in FIGS. 8 and 9 is to omit contacts 203 and 206. This will provide a switch which can have three positions in use, for example, both off (a); one on, one off (b); and both on (c). This alternative has great commercial utility; for instance, it might be used to control head and side lights of a motor vehicle and would operate as both side and head lights off (a), side lights on only with head lights off (b) and both side and head lights on (c).

In FIG. 10 is schematically shown part of a switch similar to that described with respect to FIGS. 8 and 9 but including the platform means of FIGS. 1–4.

In FIG. 10 is shown first switch gear contacts 301, 302 and 303 and second switch gear contacts 304, 305 and 306.

Contacts 302 and 305 can act as platform means and are positioned with their centres off-set from a centre line 310 through the switch but also overlapping that centre line 310.

Contact bridging members 317 and 318 will be used therewith and each can use the respective edge of the platform means adjacent the respective one of contacts 301, 303, 304 and 306 as a fulcrum or be supported on the respective one of contacts 302 and 305 out of contact with any of contacts 301, 303, 304 and 306. Further, either or both of members 317 and 318 may be supported by the platform means at any one time.

This is further illustrated in FIGS. 12*a*–12*e* where the five possible positions are shown.

The lengths of the members 217, 218, 317 and 318 are important as are the placings of contact 202 with respect to contact 205 and contact 302 with respect to contact 305 so as to ensure accurate operation but these lengths and placings will be appreciated by those skilled in the art.

The claims form part of the disclosure of this specification.

Modifications and adaptations may be made to the constructions described above without departing from the spirit and scope of this invention which includes every novel feature and combination of features disclosed herein.

I claim:

1. An electric switch of the type including a housing, an actuator moveably secured to said housing and having a portion controllably moveable along a predetermined path within said housing, at least first and second sets of electrical contacts respectively disposed in said housing along lines in accordance with said path, respective contact bridging members, one associated with each set of contacts, cooperating with said actuator portion to effect selective electrical connection of a first contact within each set with a second contact in the set, said respective first contact being adapted to operate as a fulcrum with respect to said associated bridging member, such that the bridging member pivots thereabout to selectively effect said connection; the improvement wherein:

said switch includes means for effecting said selective electrical connection in said first set of electrical contacts, prior to effecting said selective electrical connection in said second set of contacts; including means cooperating with said bridging members, and said actuator portion for effecting a sliding movement of the associated bridging member over each first contact in response to movement of said actuator portion along said path;

respective means, associated with each said first contact and including at least one fulcrum edge of the first contact disposed relative to said associated second contact for defining the fulcrum, and hence, the position of said actuator portion along said path whereat said pivoting is effected; and means for relatively offsetting in the direction of said path the fulcrum edge of the first contact of said first set with respect to the fulcrum edge of the first contact of the second set, such that said pivoting is effected in the first and second sets at differing positions of said actuator.

2. The electric switch of claim 1 wherein said sets of contacts are disposed in said housing along substantially parallel lines;

said respective second contacts are disposed side-by-side in a common plane perpendicular to said path; and said respective first contacts are disposed in spaced apart planes generally to said second contact plane.

3. The switch of claim 1 wherein each of said bridging members comprises:

a sheet of conductive material having an intermediate planar portion and end portions upturned in a direction away from said contacts.

4. An electric switch comprising:

a housing;

an actuator moveably secured to said housing and having a portion controllably moveable along a predetermined path within said housing;

at least first and second sets of electrical contacts respectively disposed in said housing along lines in accordance with said path, each said set including at least first, second and third contacts;

respective contact bridging members, one associated with each set of contacts, cooperating with said actuator portion to selectively effect electrical connection of said first contact within each set of one of said second or third contacts in the set, said respective first contacts being disposed between said associated second and third contacts;

said bridging members each including means for engaging said actuator and effecting a sliding movement of the associated bridging member over each first contact in response to movement of said actuator portion along said path;

respective fulcrum means, associated with each said first contact and including at least one edge of said associated first contact disposed relative said associated second and third contacts, for defining a fulcrum over which said associated bridging member pivots in response to said actuator portion reaching a predetermined position along said path to effect said electrical connection between said first contact and one of said second or third contacts; and means for offsetting the fulcrum edge of the first contacts of said respective sets with respect to each other in the direction of said path and effecting said pivoting in the respective sets at differing positions of said actuator.

5. The electric switch of claim 4 wherein said sets of contacts are disposed in said housing along substantially parallel lines;

the respective second contacts of said sets and third contacts of said sets are disposed side-by-side in respective common substantially parallel planes;

said respective first contacts are disposed in said spaced apart planes generally parallel to said common planes.

6. The switch of claim 4 wherein each of said bridging members comprises:

a sheet of conductive material along an intermediate planar portion and end portions upturned in a direction away from said contacts.

* * * * *